US006270364B1

(12) United States Patent
Wang

(10) Patent No.: US 6,270,364 B1
(45) Date of Patent: Aug. 7, 2001

(54) PORTABLE ELECTRICAL ADAPTER

(76) Inventor: Tongt-Huei Wang, No. 17, Wu-Chuan 6th Rd., Wu-Ku Industrial Park, Taipei Hsien (TW)

( * ) Notice: Subject to any disclaimer, the term of this patent is extended or adjusted under 35 U.S.C. 154(b) by 0 days.

(21) Appl. No.: 09/718,013

(22) Filed: Nov. 20, 2000

(51) Int. Cl.[7] ..... H01R 13/44
(52) U.S. Cl. ..... 439/131; 439/174
(58) Field of Search ..... 439/131, 174, 439/103, 369, 341, 651

(56) References Cited

U.S. PATENT DOCUMENTS 4,201,431 * 5/1980 McDonald ..... 439/103
4,605,273 * 8/1986 Horton ..... 439/369

* cited by examiner

*Primary Examiner*—Shawn Riley
(74) *Attorney, Agent, or Firm*—William E. Pelton, Esq.

(57) ABSTRACT

A portable electrical adapter is composed of a convertible plug and a transformer. The plug has a front part and a block. Two first blades are received in the front part and two sockets are defined at a bottom of the block. Two conductive strips are received in the block and each has a resilient member fixed on a distal end. Two caps are respectively pushed by the resilient members. The transformer has a notch defined therein and two second blades pivotally mounted in the notch. When the second blades are pivoted up, they can be respectively inserted in the sockets of the plug. The second blades each have an aperture defined at a first end thereof. When the second blades inserted in the sockets, the caps are respectively positioned in the apertures to electrically connect the first blades to the second blades and to stably mount the plug on the transformer. The second blades each have a circular portion formed at a second end thereof for directly and electrically connecting with a circuit board of the transformer to improve its conductivity.

2 Claims, 10 Drawing Sheets

PORTABLE ELECTRICAL ADAPTER

BACKGROUND OF THE INVENTION

1. Field of the Invention

The present invention is related to a portable electrical adapter, and more particularly to an electrical adapter which can be assembled with various plugs.

2. Description of Related Art

Because AC voltage supplies in various countries are different, a traveller often has to carry a portable electrical adapter for using electrical appliances such as a mobile phone, a shaver, etc. Furthermore, as electric outlets also have various configurations, the electrical adapter often provides a detachable plug. A conventional electrical adapter being composed of a detachable plug (80) and a transformer (90) is shown in FIGS. 6–10.

Referring to FIGS. 6–7, the detachable plug (80) has two first blades (88) extending through a front part (81) thereof. A block (82) is provided at a rear end of the plug (80) and two sockets (84) are defined through a bottom thereof The transformer (90) has a notch (92) defined therein and two second blades (94) are pivotally mounted at a bottom of the notch (92). When the second blades (94) are pivoted up to be received in the notch (92), as shown in FIG. 6, the plug (80) can be attached on the transformer (90) with the block (82) received in the notch (92) and first ends of the second blades (94) are inserted in the sockets (84). A user can change different plugs (80) with various blades (88) according to various outlets.

Referring to FIGS. 7 and 8, the plug (80) further has a back plate (85) provided at a rear surface of the front part (81). Two first conductive strips (83) are provided in the plug (80) and each has a first sheet (830) electrically connected with the respective first blade (88) and a V-like leaf (832) received in the respective socket (84). The second blades (94), which are inserted in the sockets (84), are clamped by the leaves (832).

In a case that the electrical adapter is plugged in a outlet on a wall, because of the weight of the transformer (90), the second blades (94) can disengage from the V-like leaves (832) and the transformer (90) will drop from the outlet. Thus, a metal material used to make the V-like leaf (832) must be thick enough to provide adequate clamping force for the second blades (94) to overcome the weight of the transformer (90). However, it is difficult for a user to insert the second blades (94) in the leaves (832) with high clamping force if the leaves (832) are too thick. Moreover, after long term detaching and attaching, the leaves (832) will be worn and the clamping force thereof will be reduced.

Referring to FIGS. 9 and 10, the transformer (90) has two slots (920) respectively defined at two sides of the notch (92). A bottom channel (96) is defined at a bottom of the notch (92) and in communication with the slots (920). An axle (940) is provided between second ends of the second blades (94). Two contactors (942) are respectively formed at outer surfaces of the second ends of the second blades (94). A U-like fastener (960) formed with two lateral plates and an upright plate is provided in the bottom channel (96) to clamp the axle (940) between the lateral plates. Distal ends of the lateral plates of the U-like fastener (960) are integrated with the housing of the transformer (90) by means of hot-melting.

Two second conductive strips (98) are provided in the housing of the transformer (90) and each has a second sheet (980) fixed in the housing and a finger (984) extending out from the respective slot (920). The second sheets (980) are electrically connected with a circuit board (not shown) and each has an orifice (982) defined therein for a pole (not shown or numbered) in the housing to extend therethrough. Distal ends of the poles are expanded by means of hot-melting to fix the sheets (980) on the poles. The fingers (984) each have a hook (986) formed at a distal end thereof and electrically connected with the respective contactor (942).

Because the transformer (90) is made by means of hot-melting, special machining tools for hot-melting must be provided for the process, which increases manufacturing cost and is inefficient. Furthermore, there are two "contact-points" between each of second blades (94) and the circuit board, wherein one is between the circuit board and the sheet (980), and the other is between the hook (986) and the contactor (942). Thus, a conductivity of the electrical adapter is low, and a failure rate is high.

Therefore, the invention provides an improved electrical adapter to mitigate and/or obviate the aforementioned problems.

SUMMARY OF THE INVENTION

The main objective of the present invention is to provide an electrical adapter of which a convertible plug is able to be easily and stably attached on a transformer.

Another objective of the present invention is to provide an electrical adapter which has a preferable conductivity.

Another objective of the present invention is to provide an electrical adapter which has a low manufacturing cost.

Other objects, advantages and novel features of the invention will become more apparent from the following detailed description when taken in conjunction with the accompanying drawings.

DETAILED DESCRIPTION OF THE PREFERRED EMBODIMENT

Figure 1:
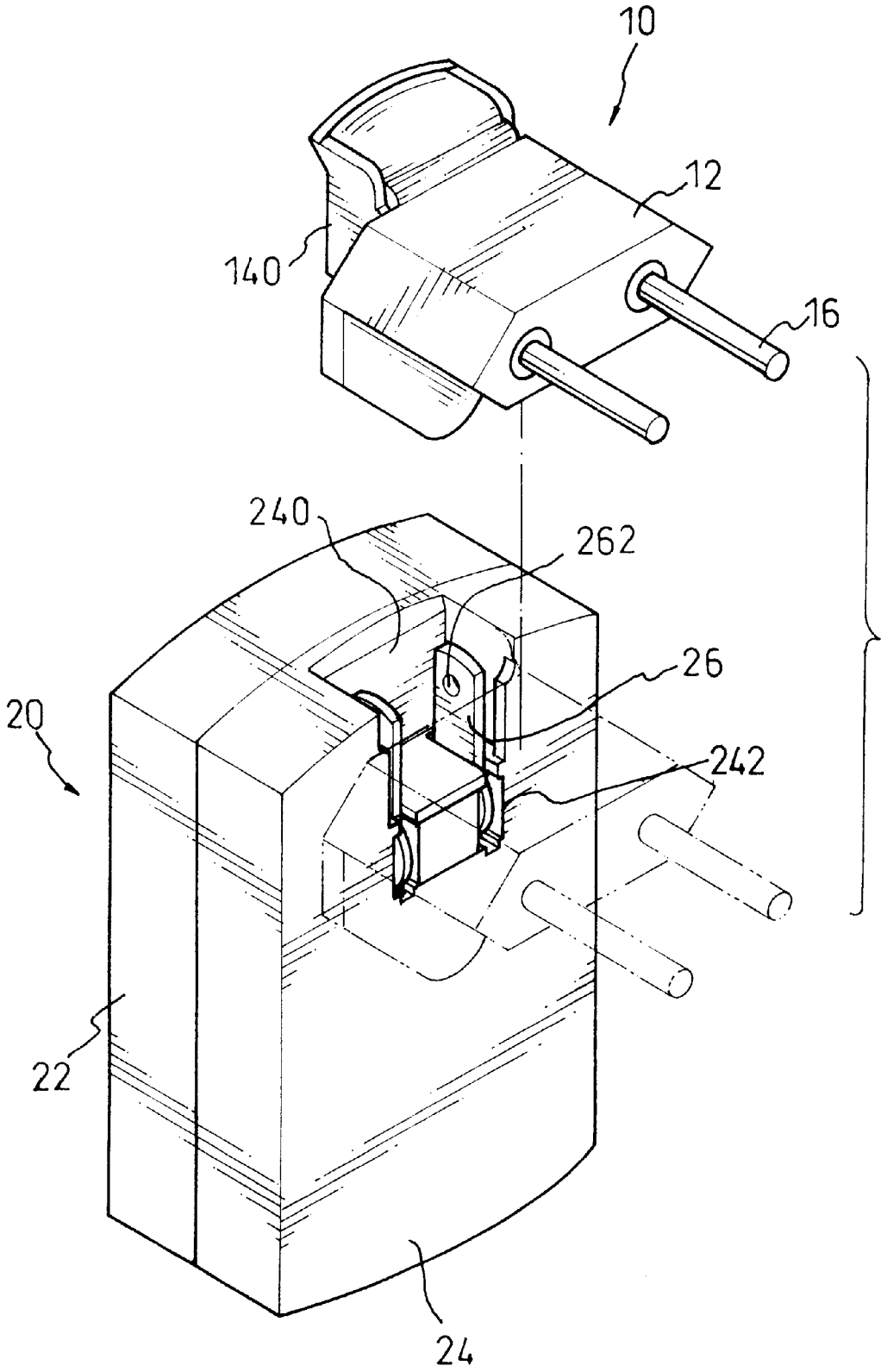
FIG. 1 is a perspective view of an electrical adapter in accordance with the invention.

Referring to FIG. 1, an electrical adapter in accordance with the present invention, of which a configuration similar to the conventional adapter, is composed of a convertible plug (10) and a transformer (20). For the sake of clarity of description, in the preferred embodiment shown in the accompanying drawings, the convertible plug (10) includes two cylindrical first blades (16), but it should be noted that other blades with various cross-sections are acceptable.

The plug (10) has a front part (12) and the first blades (16) extend out from the front part (12). A block (140) is formed at a rear end of the plug (10). The transformer (20) is composed of a first housing (22) and a second housing (24). A notch (240) is defined in the second housing (24) for receiving the block (140) therein. Two slots (242) are respectively defined at opposite side walls of the notch (240). Two second blades (26) are pivotally mounted at a bottom of the notch (240) and respectively received in the slots (242). Each of the second blades (26) has an aperture (262) defined at a first end thereof.

Figure 2:
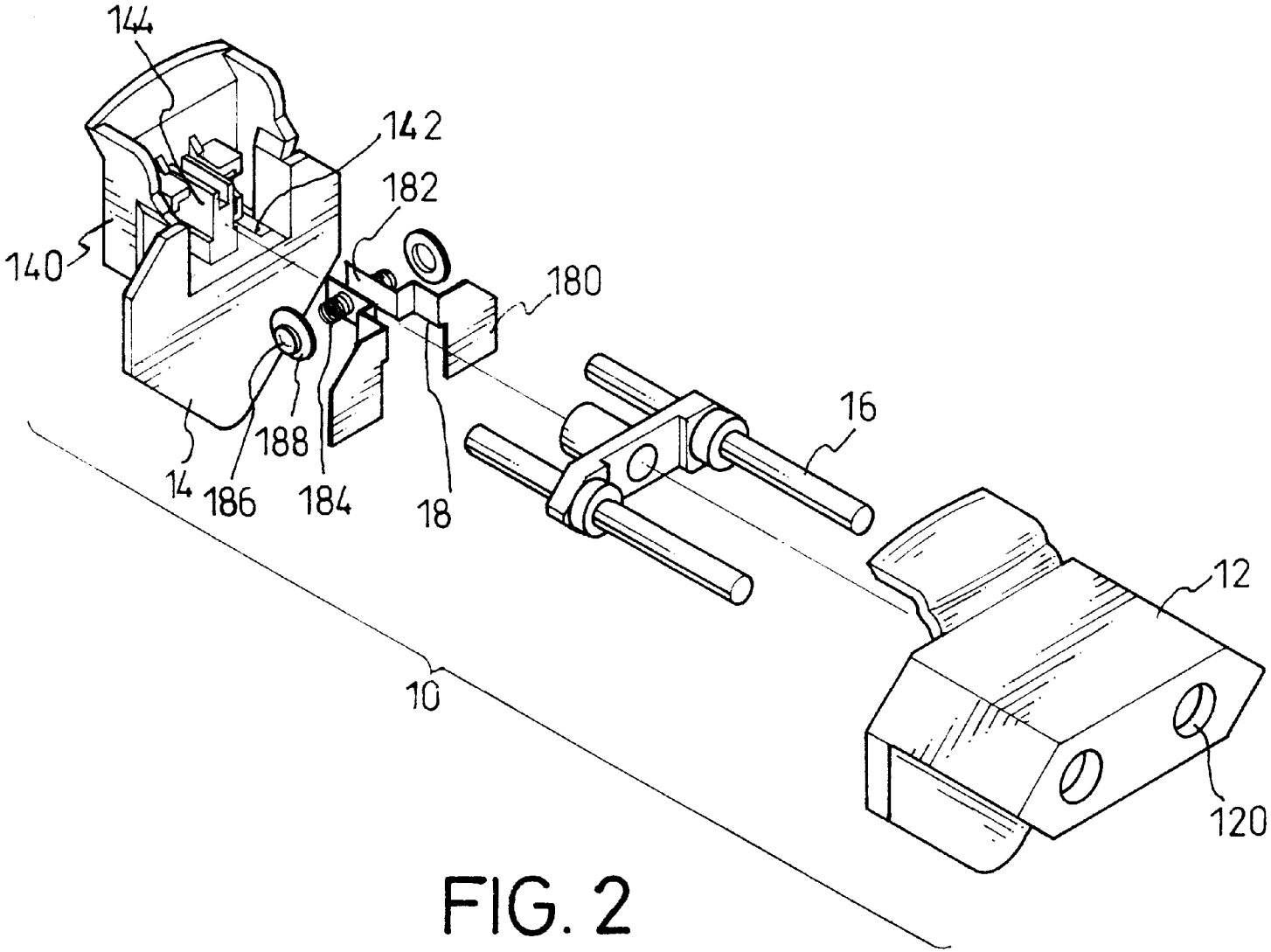
FIG. 2 is an exploded perspective view of a convertible plug of the electrical adapter in accordance with the invention.
Figure 3:
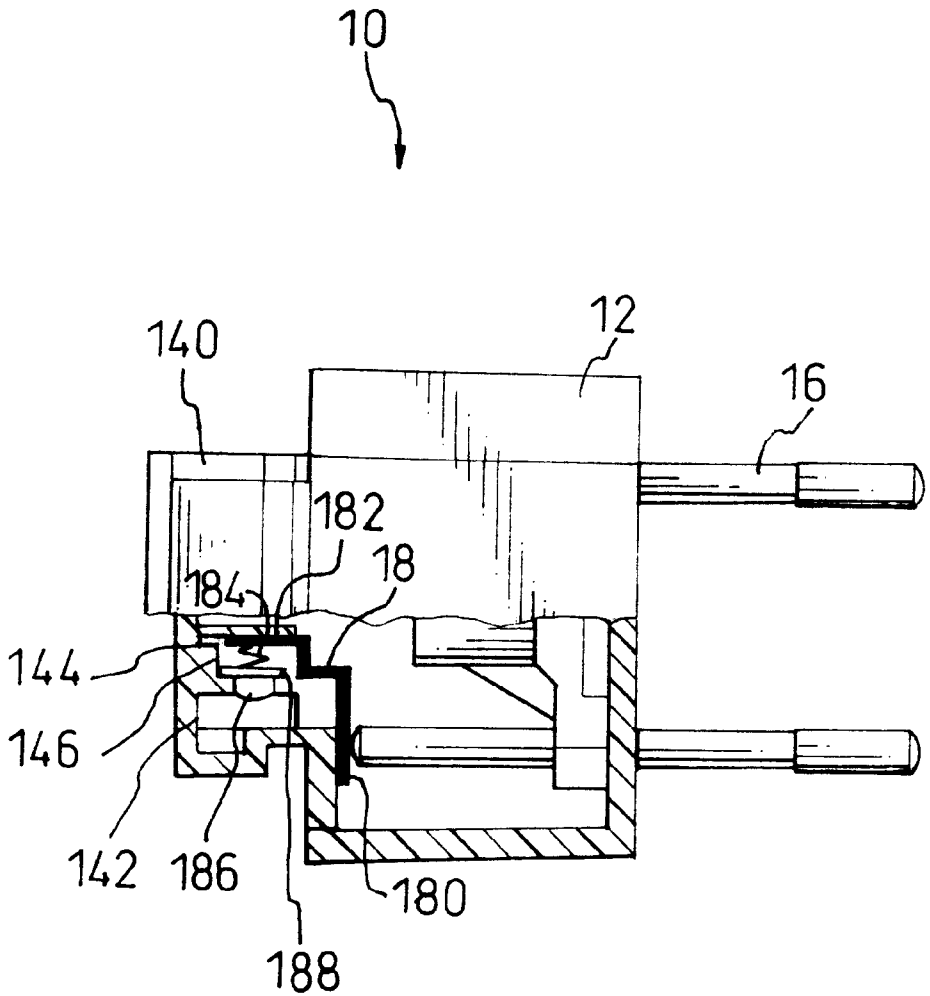
FIG. 3 is a partial sectional view of the plug in FIG. 2.

Referring to FIGS. 2 and 3, the front part (12) of the plug (10) has two passages (120) defined therethrough and the first blades (16) respectively extend through the passages (120). A back plate (14) integrated with the block (140) is mounted on the rear end of the front part (12). The block (140) has two sockets (142) symmetrically defined beside sidewalls thereof and through a bottom thereof. Two first channels (144) are symmetrically defined at two sides of the block (140) and two second channels (146) are respectively defined outside the first channels (144). Two walls (not numbered) are respectively formed between the sockets (142) and the respective second channels (146). Two conductive strips (18) each being composed of a sheet (180) and a finger (182) are provided in the block (140) with the fingers (182) respectively received in the first channels (144). The sheets (180) of the conductive strips (18) are respectively and electrically connected with the first blades (16). The conductive strips (18) each have a resilient member (184) fixed on the respective finger (182) and received in the second channel (146). Two caps (186) each with a brim (188) are respectively fixed on distal ends of the resilient members (184) and received in openings (not numbered) on the walls, with the brims (188) pushed against the wall by the respective resilient members (184). Crowns (not numbered) of the caps (186) respectively extend out the openings and enter into the sockets (142), as shown in FIG. 3.

When the plug (10) is mounted on the transformer (20) with the block (140) received in the notch (240), the second blades (26) are respectively inserted in the sockets (142) and the crowns of the caps (186) are respectively positioned in the apertures (262) of the second blades (26) under the force of the resilient members (184). Thus, the plug (10) is stably attached on the transformer (20), and is unable to disengage from the transformer (20) by the deadweight alone of the transformer (20).

Figure 4:
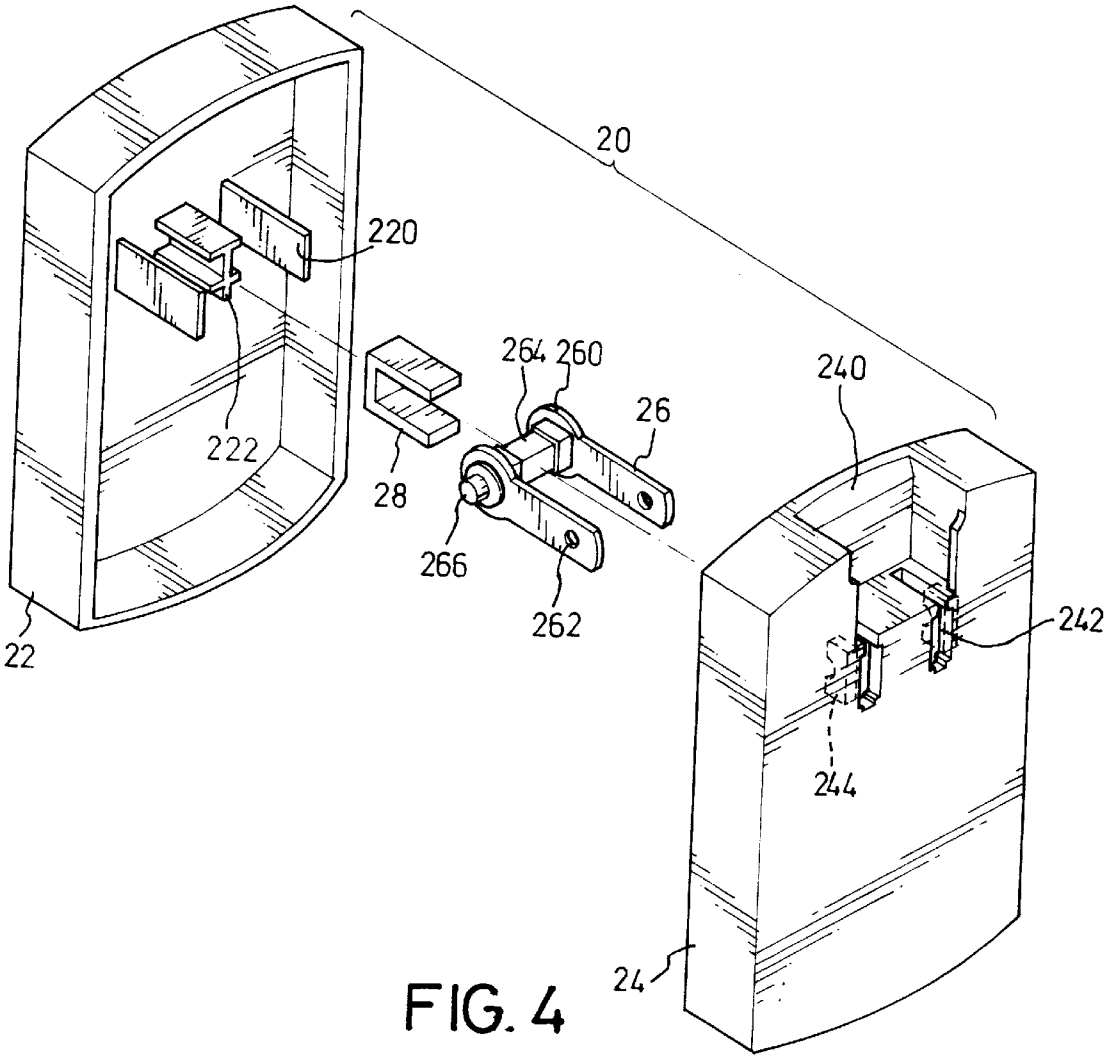
FIG. 4 is an exploded perspective view of a body of the electrical adapter in accordance with the invention.
Figure 5:
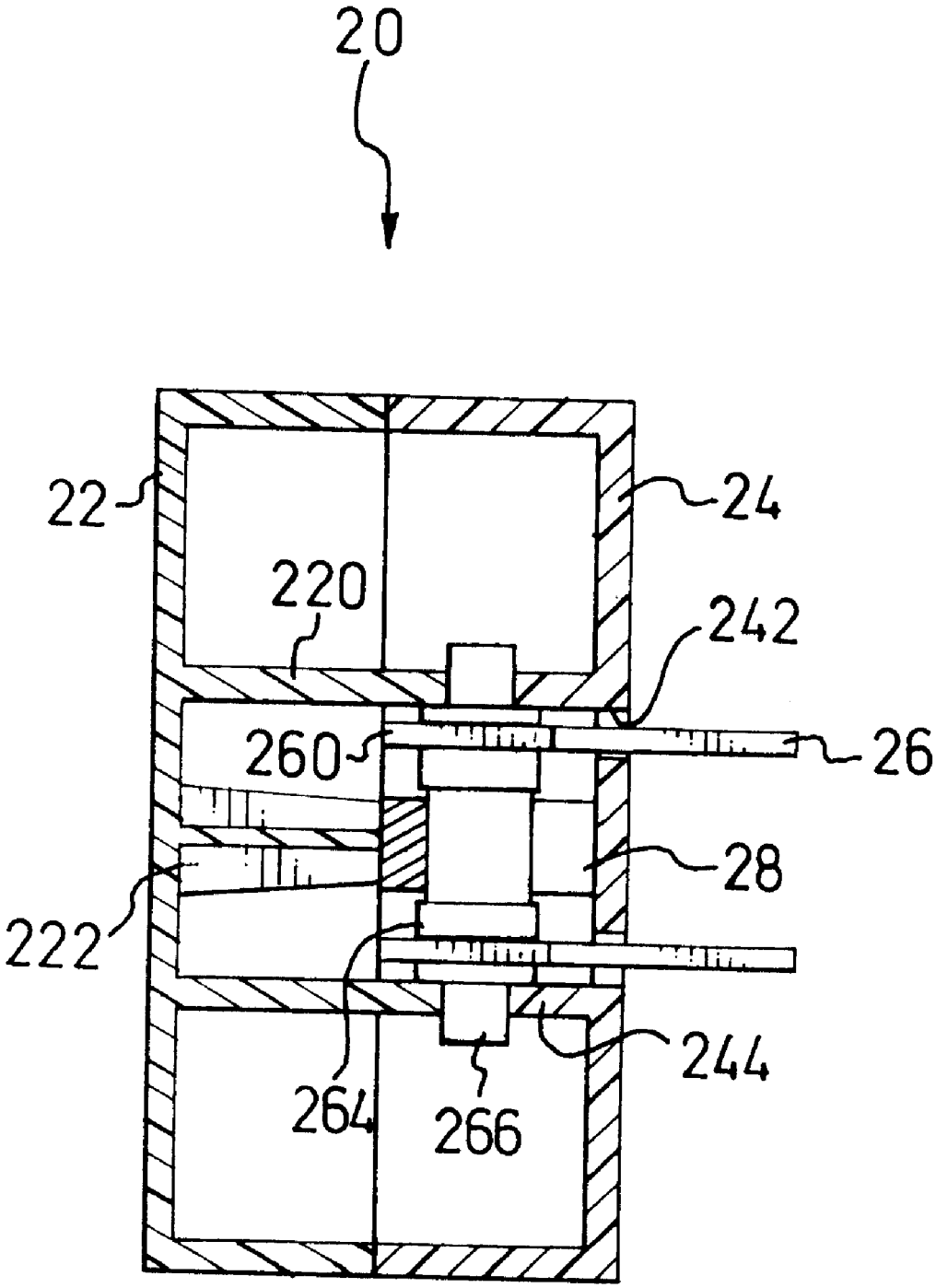
FIG. 5 is a partial sectional view of the body of the electrical adapter in FIG. 4.
Figure 6:
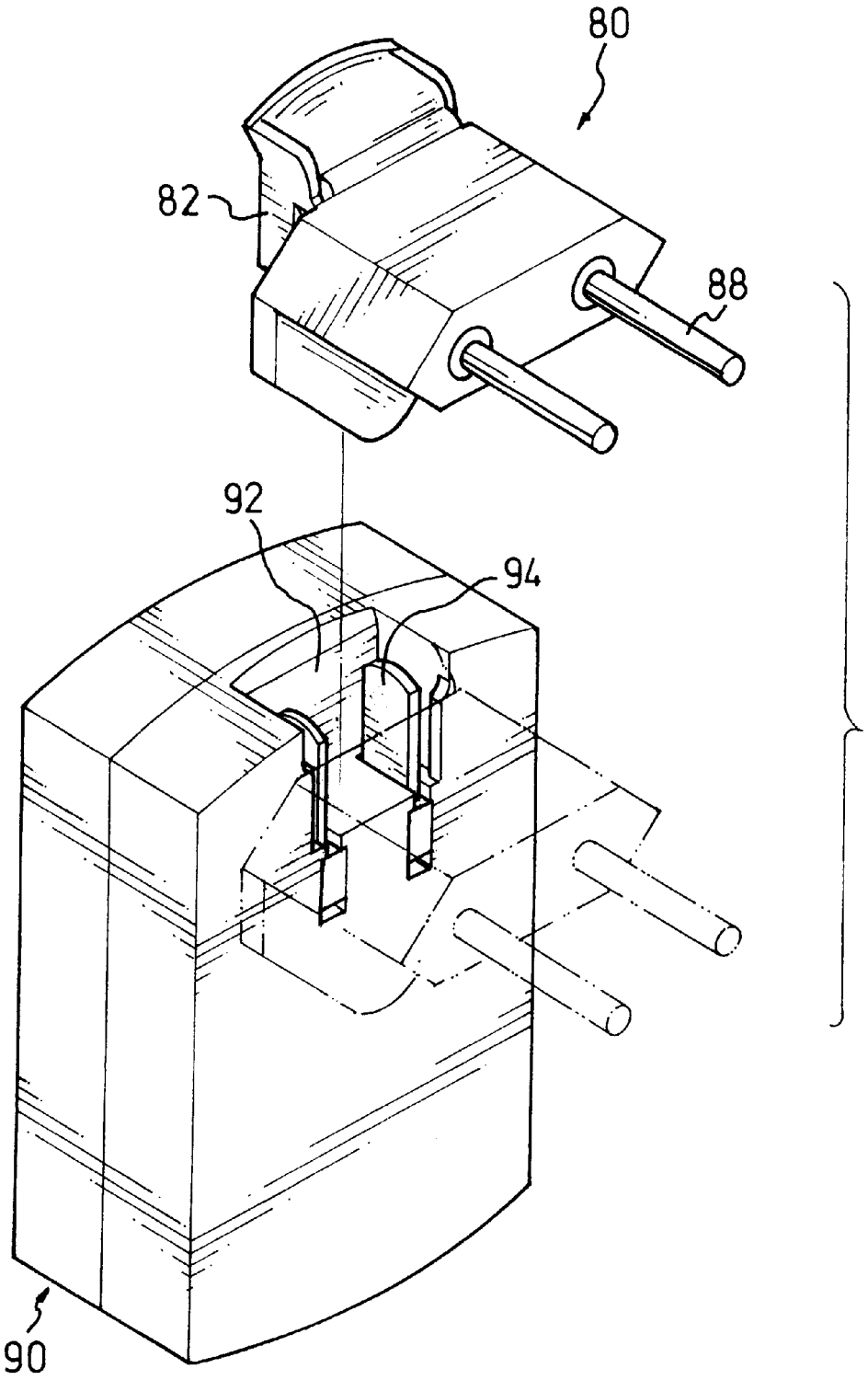
FIG. 6 PRIOR ART
FIG. 6 is a perspective view of a conventional electrical adapter.
Figure 7:
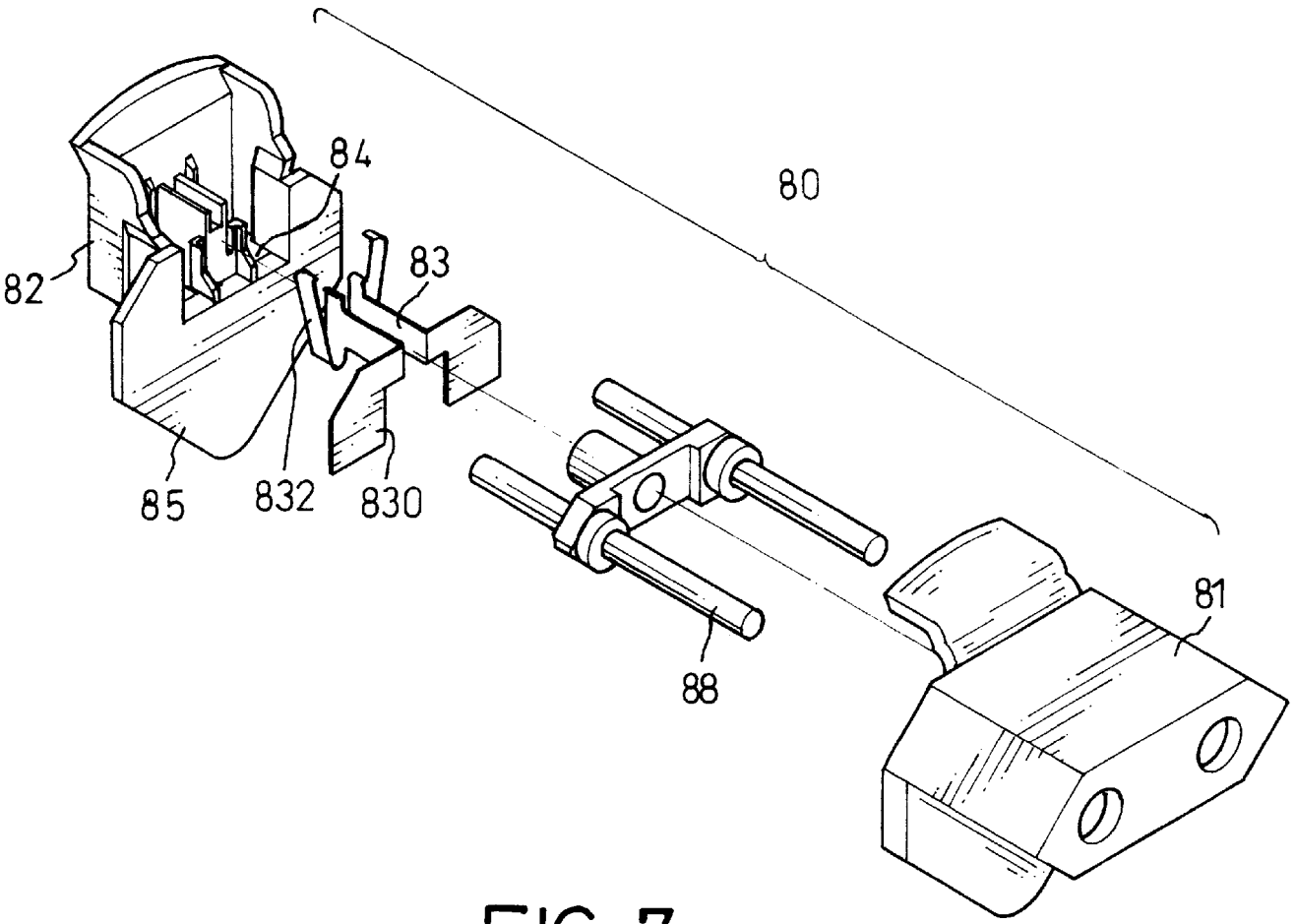
FIG. 7 PRIOR ART
FIG. 7 is an exploded perspective view of a convertible plug of the conventional electrical adapter in FIG. 6.
Figure 8:
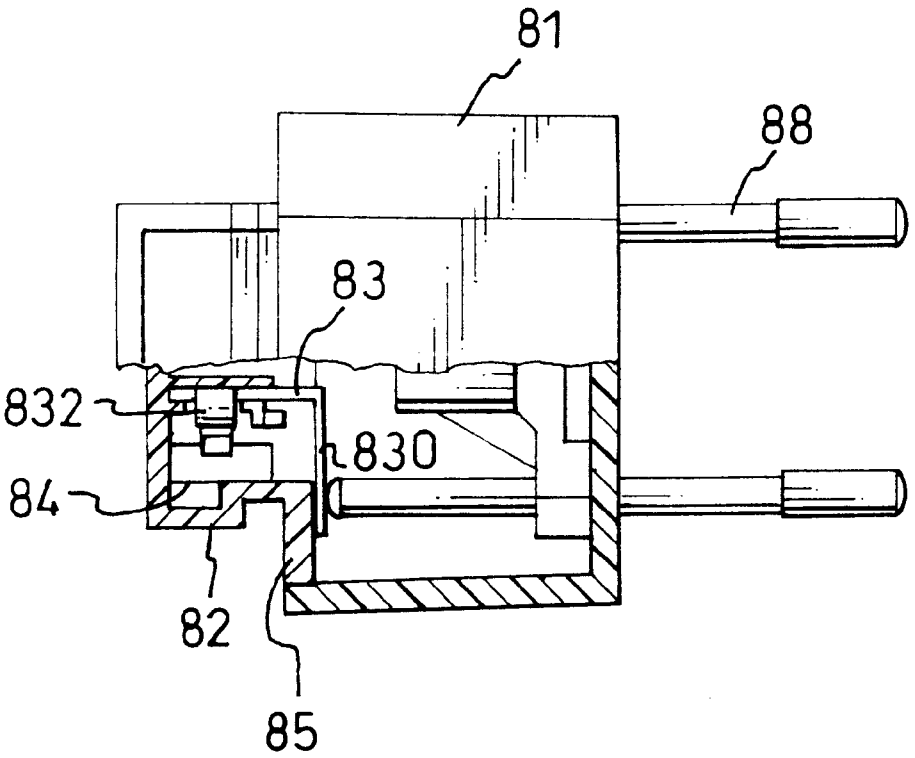
FIG. 8 PRIOR ART
FIG. 8 is a partial sectional view of the plug in FIG. 7.
Figure 9:
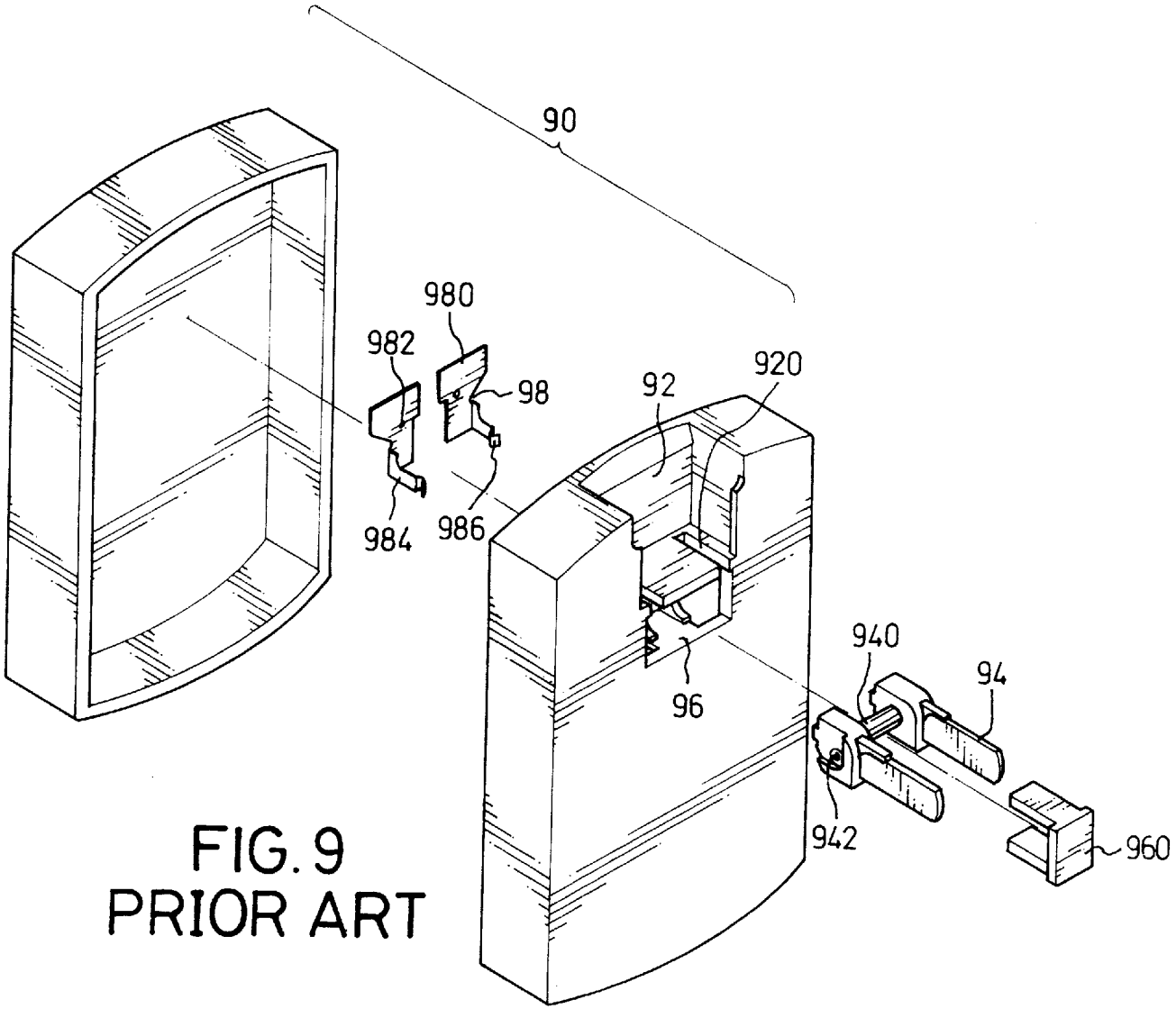
FIG. 9 PRIOR ART
FIG. 9 is an exploded perspective view of a body of the conventional electrical adapter in FIG. 6.
Figure 10:
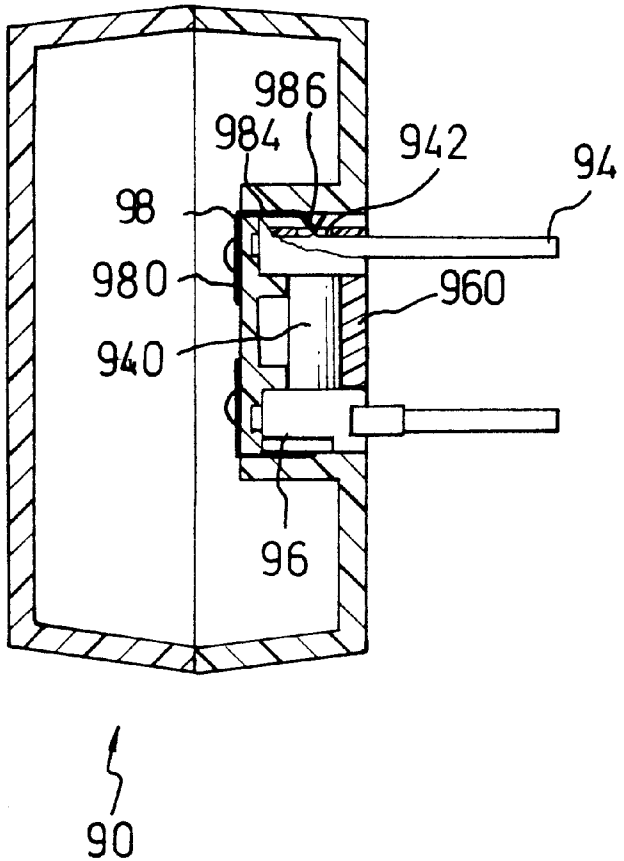
FIG.10 PRIOR ART
FIG. 10 is a partial sectional view of the body of the electrical adapter in FIG. 9.

Referring to FIGS. 4 and 5, the transformer (20) (for the sake of clarity, electrical elements such as a circuit board being eliminated) has two long arms (220) and a pole (222) between the arms (220) formed in the first housing (22). Two short arms (244) are formed in the second housing (24) to correspond to the long arms (220). The second blades (26) respectively extend out from the slots (242) defined at the bottom of the notch (240) and each have a circular portion (260) formed at a second end thereof. An axle (264) made of an isolator is provided between the two second blades (26) to connect them together. Two pins (266) are respectively formed at two ends of the axle (264) and provided between the long arms (220) and the short arms (244), when the transformer is in an assembled status. A U-like fastener (28) formed with two lateral plates and an upright plate is provided in the second housing (24) with a first end thereof abutting the pole (222) and a second end thereof abutting the inner wall of the second housing (24). The axle (264) is provided between the lateral plates of the fastener (28).

According to the present invention, the circular portions (260) are directly and electrically connected with the circuit board (not shown) in the housing, and only a single contact-point exists between each of the blades (94) and the circuit board. Therefore, the adapter has a preferable conductivity and a little chance of failure. Furthermore, as no hot-melting is required in the process, the manufacturing cost is low.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A portable electrical adapter, comprising:

a convertible plug (10) having a front part (12) with two passages (120) defined therethrough;

two first blades (16) respectively extending through the passages (120);

a back plate (14) provided on a rear end of the front part (12) to be securely connect with the front part (12), and having a block (140) formed at a rear surface thereof, two sockets (142) respectively defined through a bottom of the block (140) and at two sides of the block (140), two first channels (144) and two second channels (146) respectively and symmetrically defined beside the sockets (142), two walls respectively formed between each pair of the sockets (142) and second channels (146) and each having an opening defined through the wall;

two conductive strips (18) each having a sheet (180) electrically connected with the respective blade (16) and a finger (182) received in the respective first channel (144);

two resilient members (184) respectively provided on the fingers (182) of the conductive strips (18) with a first end thereof, and two caps (186) fixed on a second end of the resilient member (184) and respectively received in the openings of the walls and each having a brim (188) pushed against the wall by the resilient member (184) and a crown extending out from the opening and entering into the socket (142); and a transformer (20) having a notch (240) defined therein and two second blades (26) pivotally mounted at a bottom of the notch (240) and each with an aperture (262) defined at a first end of the second blade (26), whereby, when the second blades (26) of the transformer (20) respectively extend in the sockets (142) of the convertible plug (10), the caps (186) are positioned in the apertures (262) of the second blades (26) to electrically connect the plug (10) and the transformer (20) and stably attach the plug (10) on the transformer (20).

2. The portable electrical adapter as claimed in claim 1, wherein the transformer (20) is composed of a first housing (22) and a second housing (24), wherein the first housing (22) has two long arms (220) and a pole (222) between the long arms (22) formed therein;

the notch (240) is defined in the second housing (24), and the second housing (24) has two slots (242) defined at a bottom of the notch (240), and two short arms (244) formed inside the second housing (24) to correspond to the long arms (220);

the second blades (26) respectively extend out from the slots (242) and each has a circular portion (260) formed at a second end of the second blade (26);

an axle (264) extends through the second ends of the second blades (26) and has two pins (266) respectively formed outside the circular portions (260) and mounted between the long arms (220) and the short arms (244); and a U-like fastener (28), formed with two lateral plates and an upright plate, provided in the second housing (24) with a first end thereof abutting the pole (222) and a second end thereof abutting the second housing (24), wherein the axle (264) is provided between the lateral plates.

* * * * *